United States Patent [19]

Balevski et al.

[11] 4,153,100

[45] May 8, 1979

[54] LOW-PRESSURE OR COUNTERPRESSURE CASTING APPARATUS

[75] Inventors: Angel T. Balevski; Ivan D. Nikolov; Asparuch M. Antonov, all of Sofia, Bulgaria

[73] Assignee: Institut Po Metaloznanie I Technologia Na Metalite, Sofia, Bulgaria

[21] Appl. No.: 937,744

[22] Filed: Aug. 29, 1978

Related U.S. Application Data

[63] Continuation-in-part of Ser. No. 735,220, Oct. 26, 1976.

[30] Foreign Application Priority Data

Oct. 27, 1975 [BG] Bulgaria ..... 31330

[51] Int. Cl.[2] ..... B22D 17/32

[52] U.S. Cl. ..... 164/155; 164/259; 164/306

[58] Field of Search ..... 164/63, 119, 155, 304, 164/306, 308, 309, 259, 257, 254

[56] References Cited

U.S. PATENT DOCUMENTS

| | | | |
|---|---|---|---|
| 1,910,008 | 5/1933 | Gray et al. | 164/257 |

FOREIGN PATENT DOCUMENTS

| | | | |
|---|---|---|---|
| 249290 | 9/1966 | Australia | 164/306 |
| 408530 | 1/1925 | Fed. Rep. of Germany | 164/309 |
| 45-16681 | 6/1970 | Japan | 164/257 |
| 203671 | 8/1965 | Sweden | 164/306 |
| 397158 | 2/1966 | Switzerland | 164/306 |

*Primary Examiner*—William R. Briggs
*Attorney, Agent, or Firm*—Karl F. Ross

[57] ABSTRACT

A casting apparatus for low-pressure or counterpressure casting of nonferrous metals comprises a casting mold which is fed with the melt by a siphon tube opening upwardly into the mold and communicating with an intermediate crucible for molten metal. The siphon tube has an elbow lying above the level of the molten metal in the intermediate crucible which is connected to a main crucible by a conduit whose inlet into the intermediate crucible can be blocked by a bell. Gas from an inert-gas supply can be applied under pressure to the crucible and the elbow.

2 Claims, 1 Drawing Figure

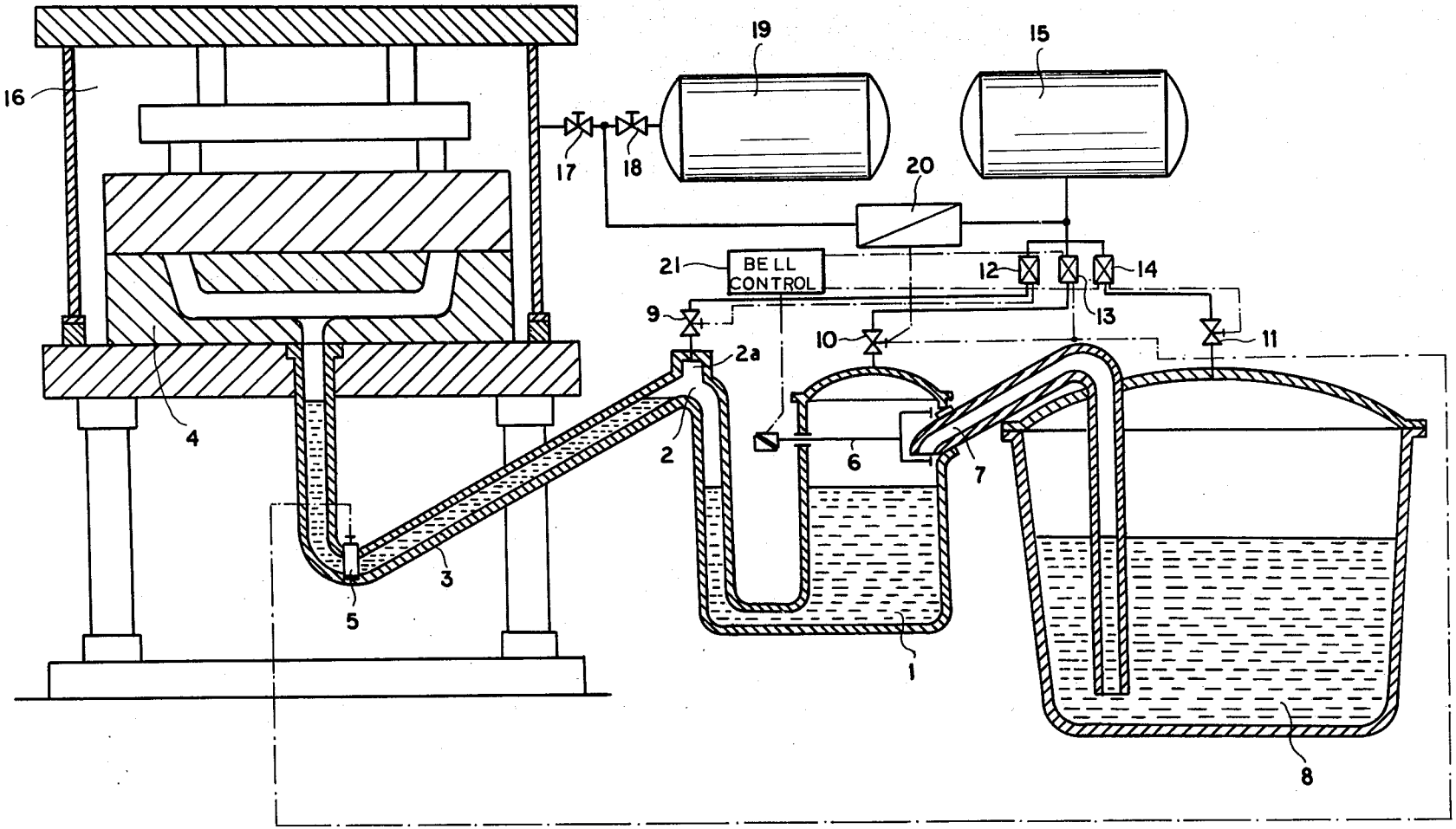
BELL CONTROL
1
2
2a
3
4
5
6
7
8
9
10
11
12
13
14
15
16
17
18
19
20
21

LOW-PRESSURE OR COUNTERPRESSURE CASTING APPARATUS

CROSS REFERENCE TO RELATED APPLICATION

This application is a continuation-in-part of our copending application Ser. No. 735,220, U.S. file date 26 Oct. 1976.

FIELD OF THE INVENTION

This invention relates to a low-pressure or counterpressure casting apparatus, which can be used for the casting of workpieces of non-ferrous metals.

BACKGROUND OF THE INVENTION

Apparatus for casting under low pressure is known, in which the crucible with the runner tube is disposed inside a hermetically sealed chamber directly under the plate which carries the casting mold. The drawbacks of these devices are that such an arrangement limits the capacity of the crucible; it is also impossible to provide ejectors and cores in the bottom half of the casting mold, since there is no place for the rejective actuating.

These drawbacks are not only a result of design considerations, but also of technology. The rise of the molten metal in the runner tube for filling the casting mold and its return result in oxidation along the walls of the runner tube which are wetted by the molten metal; the resulting oxide scale is carried into the casting mold during the next casting cycle. This can be avoided by the use of an inert gas instead of air, but this makes the process much more expensive.

The direct feeding of the casting mold from the crucible is disadvantageous because the variation of the level of the melt in it causes a variation of the velocity of filling the mold, which leads to an inconstancy of the quality of the produced castings.

The need for recharging of the crucible with molten metal, because of its limited volume, results in idling of the machine and reduces its productivity.

Low-pressure casting apparatus is known in which the crucible for the molten metal is disposed outside the device, which makes it possible to use crucibles of greater volume and to free space under the mold to receive different mechanisms. However, the ability to protect the metal from oxidation and absorbtion of gases from the air are greatly impaired.

The aforementioned drawbacks are typical also for known counterpressure casting apparatus.

OBJECTS OF THE INVENTION

It is an object of the invention to avoid the aforementioned drawbacks of existing casting apparatus and to provide conditions for reducing to a minimum the oxidation of the metal.

Another object of the invention is to provide a casting machine which provides protection of the free surfaces of the metal melt by an inert gas with a minimum consumption of the latter, the apparatus permitting different mechanisms to be disposed directly under the plate of the casting mold.

SUMMARY OF THE INVENTION

In the casting apparatus of the present invention, which has a main crucible is effected through an intermediate crucible for molten metal also disposed outside the outline of this structure.

According to an important feature of the invention, the bottom of the intermediate crucible is connected by means of a siphon melt conduit directly to the casting mold. The upper part of the intermediate crucible is connected by means of a second melt conduit to the main crucible, the inlet of the second melt conduit into the intermediate crucible being opened and closed by a controllable gate of the gas-tight bell type. It is required that the level of the molten metal in the intermediate crucible be below that of the controllable gate.

A further characteristic feature of the invention is that the upper elbow of the siphon-type melt conduit, leading to the casting mold, is disposed at a level close to that of the inlet into the casting mold and is provided with a pocket in which a gas cushion is formed. This pocket, as well as the spaces in the intermediate crucible and in the main crucible which are free from molten metal are connected by means of known control members to a gas-supply system for delivering inert gas, which, for its part, is connected by means of a known control member to a second gas-supply system for delivering air for the control of the pressure inside the casting mold for casting under counterpressure.

A further characteristic feature of the invention is that the highest level of the molten metal in the intermediate crucible is lower than the level of the upper elbow of the siphon-type melt conduit.

For effecting the process of casting, in accordance with the invention, inert gas is fed to the intermediate crucible, which is filled with the necessary quantity of molten metal, the bell of the second metal conduit leading from the main crucible being closed. The pressure of the inert gas is controlled in accordance with the velocity of the filling of the casting mold. Simultaneously, the control member for the pressure in the upper elbow of the siphon-type melt conduit is also actuated, in order to allow the melt to pass through the conduit, driving the gas from the upper elbow, where a gas cushion had been formed, which after the filling of the casting mold and the relief of the pressure in the intermediate crucible is reformed to interrupt the metal flow.

To effect the process, it is necessary that all spaces of the machine are hermetically sealed. Thus, a protection of the molten metal from oxidation is achieved in the main crucible, as well as in the intermediate crucible and the siphon-type melt conduit.

The invention has further advantages, such as:

the influence of the varying level of the molten metal in the main crucible on the velocity of filling the casting mold is eliminated;

the space under the casting mold is made available for actuating mechanisms etc.;

idle periods of the machine for recharging the basic crucible with metal are avoided;

it is possible to connect several casting machines equipped with individual intermediate crucibles, to one main crucible.

All this leads to an improvement of the quality of the castings and to an increase of the productivity of the machines.

BRIEF DESCRIPTION OF THE DRAWING

For a better understanding of the invention, its operating advantages and specific objects attained by its use, reference should be made to the sole FIGURE of the accompanying drawing in which there is illustrated, as described below, a preferred embodiment of the invention.

SPECIFIC DESCRIPTION

The intermediate crucible 1 has a molten metal capacity sufficient for one or several operating cycles of the apparatus and is disposed outside the mold structure at such a height, that at the highest level of the melt inside the crucible 1, it remains lower than the level of the upper elbow 2 in the inclined branch of the siphon-type melt conduit 3, which connects the intermediate crucible 1 with the casting mold 4. In the bottom elbow of the conduit 3 there is provided a stopper valve 5 which, in the non-operating position of the apparatus as shown in the drawing, is closed and is intended to prevent undesired variations of the level of the metal in the conduit 3.

In the upper portion of the intermediate crucible 1, at a level which cannot be reached by the level of the melt, there is disposed a gas-tight bell 6, shown diagrammatically in the drawing, which is controlled from outside by a bell control 21 to which it is connected, as shown in dot-dash lines, and covers up the inlet orifice of the feeding melt conduit 7, which connects to the main crucible 8 containing molten metal, whose volume and disposition are arbitrary and are determined appropriately in accordance with the conditions in the plant, for the feeding of one or several casting machines, for example. The main crucible 8 is also hermetically sealed.

The upper elbow 2 of the siphon-type metal conduit 3, as well as the spaces over the metal in the intermediate crucible 1 and in the main crucible 8 are connected, as shown in dot-dash lines, by means of valves 9, 10 11 and respective pressure-control members 12, 13, 14 to one another to a reservoir or container 15 for pressurized inert gas. The chamber 16, inside which the casting mold 4 is disposed, is connected by means of valves 17 and 18 to a reservoir 19 for pressurized air, while both gas systems, for the air and for the inert gas, are interconnected by a known control device 20, operably connected to valve 10, as shown in dot-dash lines, and is used for balancing and controlling the pressure differential between them.

The machine in accordance with the present invention operates as follows:

At equalized pressure in the intermediate crucible 1 and the main crucible 8, a command is fed by bell control 21, which is responsive to pressure-control members 13 and 14, to the gas-tight bell 6, which is opened and then, by increasing the pressure in the main crucible 8, a portion of melt is poured over into the intermediate crucible 1, which is sufficient for one or more castings. After equalizing the pressure in both crucibles, which is monitored by pressure-control members 13 and 14, thus causing the interruption of the metal flow, a command is fed for closing the gas-tight bell 6. For filling the casting mold 4 with melt, the stopper valve 5 of the conduit 3 is opened by the valve 10, to which it is changed as shown in dot-dash lines, to admit the inert gas. The pressure in the intermediate crucible 1 is increased and the melt from it rises through the siphon-type conduit 3 into the casting mold 4, driving out the gas from the upper elbow 2 and the pocket 2*a*, thereby removing the gas cushion which had been formed therein.

After filling the casting mold 4 and the partial solidification of the melt, the pressure in the intermediate crucible 1 is relieved, the valve 9 provides atmosphere pressure in the upper elbow, and as a result the metal from the vertical branch of the siphon-type melt conduit 3 descends gravitationally below the level of the upper elbow 2, the metal flow being interrupted. This level itself is chosen appropriately at the smallest possible distance from the level of the inlet of the siphon-type melt conduit 3 into the casting mold 4.

For casting under counterpressure, the counterpressure is produced with pressurized air from reservoir 19 by means of the valves 17 and 18, the control device 20 having the function of controlling the pressure inside the intermediate crucible 1, by adjustment of valve 10, controlling the inert gas so that its magnitude is higher than that in chamber 16 of the casting mold in order to effect a displacement of the molten metal.

Timing of the action of all control members can be effected by known techniques used for control casting machines.

We claim:

1. An apparatus for the low-pressure and counterpressure casting of a molten metal, comprising:

a mold-support structure having a plate carrying a mold, said plate being formed with an inlet for feeding molten metal into said mold:

a main crucible for receiving molten metal, said main crucible being hermetically sealed and provided with a delivery conduit reaching into the molten metal in said main crucible for transferring the molten metal therefrom;

an intermediate crucible receiving molten metal from said delivery conduit, said delivery conduit opening into said intermediate crucible at a location above the bottom thereof, said intermediate crucible being hermetically sealed and having an outlet disposed below the level at which said delivery conduit communicates with said intermediate crucible;

a siphon conduit having an upwardly extending stretch communicating at its lower end with said outlet, an elbow at the upper end of said upwardly extending stretch substantially at the level of said inlet, a downwardly extending stretch running from said elbow, and a further stretch rising from said downwardly extending stretch to said inlet of said mold, said elbow being disposed above the level of the molten metal in said intermediate crucible;

a stopper valve along said siphon conduit between said inlet to said mold and said elbow;

a source of an inert gas under pressure;

first control means, second control means and third control means respectively connecting said source with said main crucible, said intermediate crucible and said elbow for regulating the inert-gas pressure therein to displace molten metal from said main crucible to said intermediate crucible and from said intermediate crucible to said mold and for establishing an inert-gas cushion at said elbow separating molten metal in said stretches of said siphon conduit; and a gate in said intermediate crucible for selectively unblocking the end of said delivery conduit opening into said intermediate crucible and for the gas-tight sealing thereof.

2. The apparatus defined in claim 1, further comprising a counterpressure chamber on said structure enclosing said mold, a source of air under pressure connected to said chamber, and control means connecting said sources for balancing the pressures applied by said sources to said crucibles and said chamber, respectively.

* * * * *